United States Patent [19]

Duke

[11] Patent Number: 4,723,390

[45] Date of Patent: Feb. 9, 1988

[54] TENSIONING APPARATUS AND METHODS FOR PLASTIC PACKAGING

[76] Inventor: Horace W. Duke, Rte. 2, Box 342 Evergreen Rd., Frankfort, Ky. 40601

[21] Appl. No.: 895,141

[22] Filed: Aug. 11, 1986

[51] Int. Cl.[4] ..... B65B 7/02

[52] U.S. Cl. ..... 53/372; 53/373; 493/406

[58] Field of Search ..... 53/372, 371, 373, 138 A; 493/406

[56] References Cited

U.S. PATENT DOCUMENTS

| | | | |
|---|---|---|---|
| 3,163,969 | 1/1965 | Irwin et al. | 53/138 A X |
| 3,420,034 | 1/1969 | Saraisky et al. | 53/372 X |
| 3,471,990 | 10/1969 | Bonuchi et al. | 53/372 X |
| 3,552,088 | 1/1971 | Niwa | 53/372 X |
| 3,621,632 | 11/1971 | Browning | 53/138 A |

*Primary Examiner*—James F. Coan
*Attorney, Agent, or Firm*—James C. Kesterson

[57] ABSTRACT

A method and apparatus for tensioning or drawing taut a plastic bag or packaging around a product prior to sealing is disclosed. The apparatus operates in combination with presently available conveying means and packaging sealing means. The apparatus includes a housing to support and contain a pair of conical brushes having rotational axes parallel to the direction of travel of the conveyor belt. The conical brushes rotate in opposite directions so as to draw excess packaging material into the nip formed by the tip of the brushes to smooth away wrinkles and/or folds. A transport and gripping belt then closes the bag and moves it past a pair of cylindrical shaped brushes which may be on the same shaft as the conical brushes. The cylindrical brushes draw the packaging material tight or taut around the product in a manner suitable for sealing. Drive motors for the transport belt and the rotating brushes include means for varying the respective speeds such that various products and packaging materials can be handled.

14 Claims, 6 Drawing Figures

Space
Overlap

TENSIONING APPARATUS AND METHODS FOR PLASTIC PACKAGING

TECHNICAL FIELD

This invention relates generally to apparatus and methods for packaging a product, and more particularly to apparatus and methods for drawing or stretching plastic packaging material taut around a product prior to sealing the open end of the package by heat or other means. The apparatus and methods of this invention operating in combination with presently available conveyor belts and sealing and trimming apparatus.

BACKGROUND ART

Both transparent and opaque plastic films are used as wrapping and/or packaging materials in substantially every area of manufacturing and marketing of modern commerce. The plastic packaging materials include rigid materials which provide protection from outside impact or crushing forces, including the somewhat flexible but brittle packaging materials which provide a form fit around the product. This type of plastic packaging material may typically be heated so that it shrinks around the product. In addition, extremely pliable plastic films are used which do not always protect the product from outside crushing or impact forces, but do provide excellent protection against undesirable environment, such as moisture, dirt, sand, corrosive air or gases, etc.. The present invention is primarily concerned with such pliable plastic materials.

More particularly, the present invention is concerned with drawing the pliable packaging material taut around the product prior to sealing the open end of the package. Drawing the material taut helps eliminate use of excessive material, and also helps maintain the integrity and shape of the product so as to allow easier storage, stacking and display of the product. However, in addition to drawing the packaging taut around the product, the apparatus must also avoid crushing or distorting the shape of the product during the sealing process by drawing the packaging material too taut.

Therefore, it is an object of this invention to provide methods and apparatus for drawing a pliable plastic wrapping material taut around a product (including fragile products) prior to sealing the package, and without injury to the product.

There are, of course, various techniques for closing or sealing pliable plastic materials around a product. For example, a loaf of bread may be placed in a pliable plastic bag, the open end gathered together and then a wire-tie or plastic clip placed around the gathered material to close the package. Although it is understood that the Kwik-Lok company has used large, five (5) inch diameter brushes to help gather the material of a plastic bag for closing the package with a wire-tie or plastic clip, it is clear that the use of such brushes could not accomplish the intent of the present invention. U.S. Pat. Nos. marked on KWIK LOK equipment, but not available to the applicant at the time of filing include: 3,526,337; 3,519,196; 3,481,461; 3,446,344; 3,439,867; 3,417,912; 3,417,864; 3,417,863; 3,412,895; 3,381,442; 3,370,396; 3,270,874; 3,270,873; 3,270,872; 3,270,481; 3,190,053; 3,164,250; 3,164,249; 3,163,972; 3,163,970; 3,163,969; 3,067,534; 3,061,983; 2,907,586; and 2,705,100. The use of wire-ties or plastic clips to close plastic bags have been used to a much lesser extent for protecting and enclosing articles of clothing, linens, other cloth items and the like. However, to better display the product, to protect the product from wrinkles while in the package, and to maintain the shape of the packaged product to facilitate stacking and storage, it has been found that packaging material should closely conform to the shape of the product, and the packaging material sealed around the perimeter or edge of the product (such as by heat) with a minimum amount of excess material. Therefore, it is another object of this invention to draw the packaging material taut around the product so that the packaging can be sealed proximate the edge of the product.

To assure the minimum use of packaging material, and to ensure a more attractive product, it is desirable that the sealed packaging material include a minimum of folds and/or wrinkles at the seal. Therefore, it is yet another object of this invention to provide means for smoothing away wrinkles and folds in the packaging material prior to sealing.

DISCLOSURE OF THE INVENTION

Other objects and advantages of the invention will in part be obvious, and will in part appear hereinafter, and will be accomplished by the present invention which provides methods and apparatus for operating in combination with apparatus or means for sealing the open end of plastic packaging around a product such as by heat sealing. The apparatus also operates with conveying means for carrying the opened ended packaging containing the product along a predetermined path through the sealing apparatus as well as the apparatus of this invention.

To provide a taut package prior to sealing, the apparatus of this invention which is suitable for accomplishing the methods of this invention comprises a housing located proximate the side edge of the conveying means for containing and/or supporting the components of the invention. Adjacent the housing, and preferably attached thereto is a guide means which gathers the excess plastic material located at the open end of a package and guides or directs the material toward an entry point of the housing containing other components of the invention. Means for gripping the excess plastic material and at least partially closing the packaging around the product prior to transporting the material at the open end of the product through the housing is also provided. The gripping means may also be used to move the open end of the packaging through heat sealing apparatus, and includes a pair of small parallel running tractor belts which squeeze and hold the unsealed end of the package together during the sealing process.

In a preferred embodiment, the gripping or transport means moves the excess material at the open end of a package into the nip between the bristle tips of a pair of conical shaped brushes having parallel longitudinal axes supported and/or contained by the housing. The longitudinal axes are parallel to the direction of travel of the conveyor belt, and in addition the pair of conical brushes will typically constitute a lower and upper brush with the apex or small end of the brushes oriented toward the approaching package containing the product. The upper and lower brushes rotate in opposite directions such that the nip between the tips of the bristles tends to pull the packaging material into the brushes. Although the conical brushes just discussed may not be essential to practice the primary teachings of the present invention, or with respect to every embodiment, it has been found that the conical brushes smooth the wrinkles and folds out of the excess material prior to the package being pulled taut around the product by the primary or cylindrical brushes as discussed hereinafter.

A pair of primary brushes are located along the predetermined path of travel and are also supported and/or contained by the housing in an upper and lower arrangement. The upper and lower terminology used to describe the relative positions of the cylindrical and conical shaped brushes, although representing the preferred arrangement or position, is to aid in the understanding of the invention, and it will be appreciated that the brushes could be positioned different than in an upper and lower arrangement. These primary brushes are substantially cylindrical in shape and also have their longitudinal or rotational axes extending parallel to the direction of travel of the conveying means. The longitudinal axes of the pair of cylindrical brushes are selectively spaced apart such that at a first position the tips of the bristles of the pair of brushes are separated by about one sixteenth (1/16) inch, and at the second position the tips of the bristles of the brushes overlap by about three sixteenth (3/16) inch. As was the case with the smoothing or conical shaped brushes, the pair of cylindrical shaped brushes rotate in opposite directions such that the packaging material is drawn into the brushes so as to pull the packaging taut around the product. The tautness of the packaging around the product is selectively controlled by means which selectively position the bristle tips of one brush with respect to the bristle tips of the other brush. As will be appreciated, the more overlap of the bristle tips, the more taut the packaging around the product.

In addition, means are also provided to selectively control the rotational speed of the brushes and the speed the gripping means moves the packaging through the apparatus.

BRIEF DRSCRIPTION OF THE DRAWINGS

The above mentioned features as well as other features of the present invention will be more clearly understood from the consideration of the following description in connection with the accompanying drawings in which.

BEST MODE FOR CARRYING OUT THE INVENTION

Figures 1, 3A, 3B, 4A, 4B:
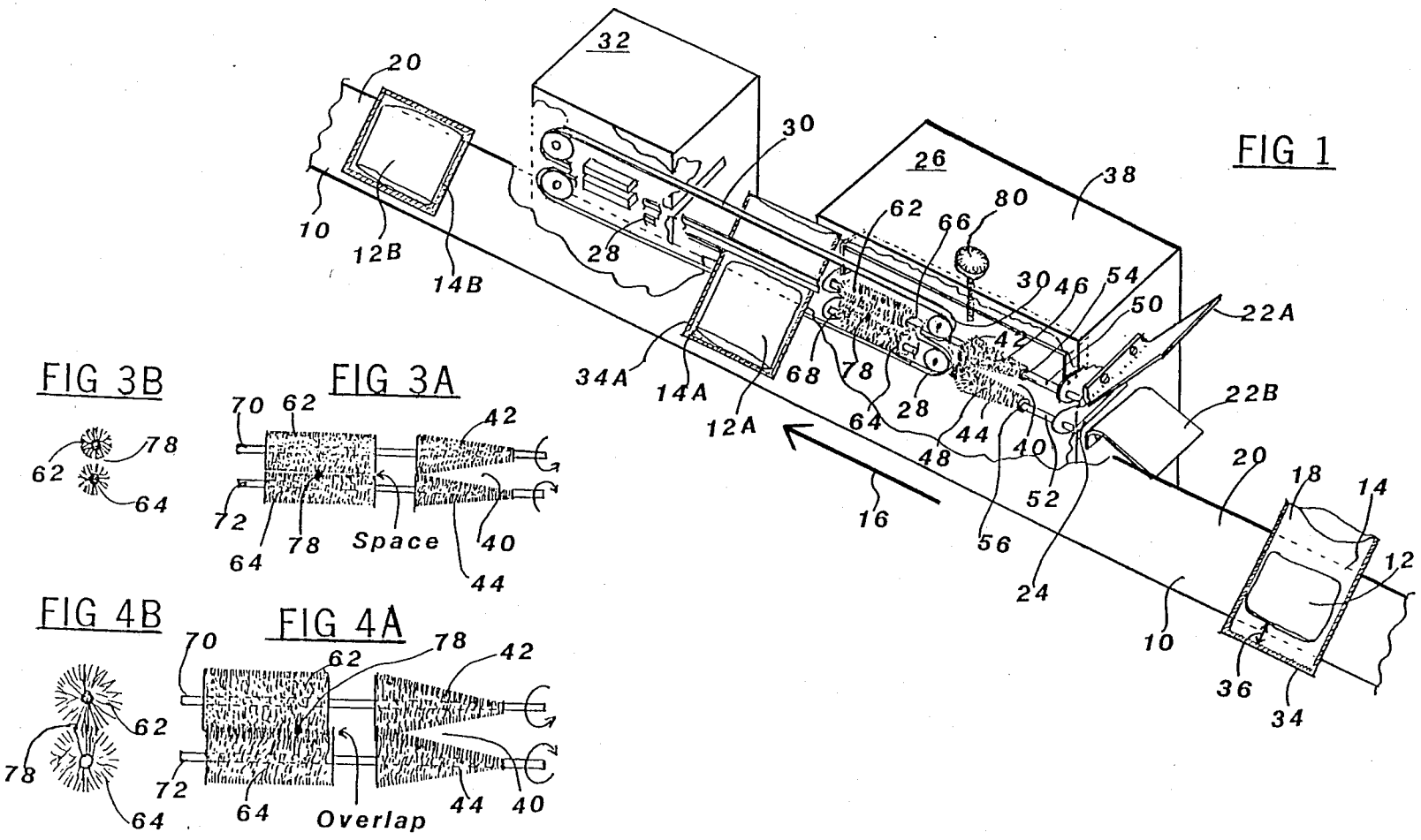
FIG. 1 is a perspective view showing the cooperation of the present invention with conveying means and packaging sealing means.
FIGS. 3A and 3B show a front and end view of the cylindrical brush pair adjusted such that the tips of the brush bristles do not make contact.
FIGS. 4A and 4B show the brush pair adjusted with maximum overlap of the tips of the bristles.

Referring now to FIG. 1, there is shown a perspective view of a packaging system incorporating apparatus of the present invention in combination with a conventional conveying means and typical heat sealing apparatus for plastic packaging materials. As shown, conveyor belt 10 moves a product 12 which has been placed in a plastic bag 14 along a predetermined path as indicated by arrow 16. As seen in FIG. 1, it should be understood that the plastic bag 14 has not yet been sealed around the product 12. As will also be appreciated by those skilled in the art, the plastic bag or packaging 14 containing the product 12 (which as an example could be a folded garment) has been placed on conveyor 10 such that the excess packaging material 18 extends beyond edge 20 of conveyor belt 10 and transverse thereto. The excess plastic packaging material 18 is then gathered by a horizontal "V" shaped guide means 22A and 22B which guides the excess material 18 into the entry point 24 of the tensioning apparatus 26 of this invention where it is gripped by two transport belts 28 and 30 which will move the plastic bag containing the product 12 through tensioning apparatus 26 of this invention and the sealing and trimming apparatus 32.

As shown, the product 12 has not been placed as far into plastic bag 14 as is possible, and consequently, there is a space in the package 14 between the product 12 and the bottom seam 34 as represented by arrow 36. However, after passing through the tensioning apparatus 26 of this invention the similar packaging 14A has been drawn taut around a similar product 12A such that the product is snug against the bottom seam 34A. The two transport belts 28 and 30 (also referred to as the gripping means) maintains the plastic bag 14A taut around the product 12A until the open end of the bag is sealed at a location close to the product so as to substantially maintain the tautness of the packaging material around the product. The combination plastic bag 14B and product 12B illustrate the package after both sealing of the bag and trimming of the excess material.

Although the embodiment illustrated in FIG. 1 and the remainder of the figures refers to pliable plastic or polyvinyl materials which are closed by heat sealing apparatus, it will be appreciated that other types of packaging materials such as fabric, cloth or paper may also be used with the apparatus of this invention. In addition, other sealing techniques such as stitching, adhesive bonding, or the like may also be used.

Figure 2:
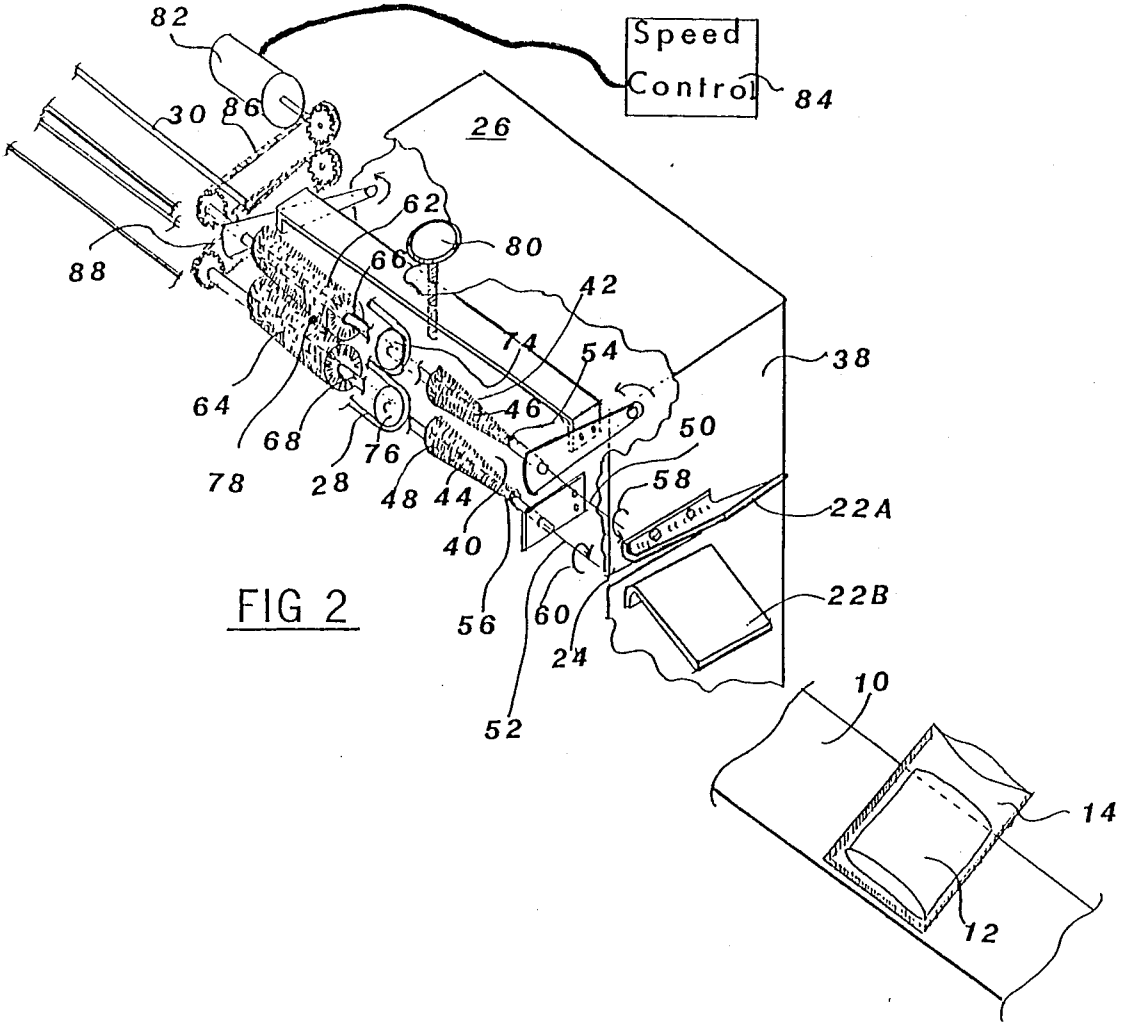
FIG. 2 is a partial break-away and perspective view of the apparatus of the present invention with most of the housing removed.

Referring now to FIG. 2, there is shown a preferred embodiment of apparatus 26 of this invention broken away from the supporting and containing housing 38. As was discussed with respect to FIG. 1, conveying belt 10 moves the combination product and open ended packaging toward the tensioning apparatus 26 of this invention. As the package approaches, horizontal "V" shaped guides 22A and 22B gather the excess material located at the open end of the package and guides it to entry point 24.

As shown, conveyor belt 10 moves the combination product 12 and packaging or plastic bag 14 such that the excess material at the open end of the bag passes into the nip 40 between the bristle tips 42 and 44 of conical shaped brushes 46 and 48. The rotational or longitudinal axes 50 and 52 of conical shaped brushes 46 and 48 are located parallel to the direction of travel of the conveyor belt 10. Also as shown, brushes 46 and 48 have an upper and lower arrangement so as to readily receive the excess packaging material. However, for some applications the excess packaging material may not approach the tensioning apparatus 26 in a fully horizontal orientation, such that the upper and lower arrangement of brushes 46 and 48 must be different so as to better accommodate the material as it moves through the brushes. Thus as was discussed heretofore, it will be appreciated that the terminology upper and lower with respect to the conical brushes 46 and 48 as well as with respect to the primary or cylindrical shaped brushes to be discussed herinafter is for convenience only, and the applicant does not intend to be limited by such terms.

As can be seen, the conical brushes 46 and 48 are oriented such that the apexes 54 and 56 of each brush encounters the approaching package first. It will further be appreciated that the brushes 46 and 48 rotate around their longitudinal axes 50 and 52 in opposite directions as indicated by accurate arrows 58 and 60 such that the excess packaging material is drawn into the nip 40. The rotating conical brushes smooth folds and wrinkles out of the excess plastic material prior to it being gripped by transport belts 28 and 30.

The smooth, wrinkle and fold free material is then gripped and closed by transport belts 28 and 30 prior to the package moving into the pair of primary or cylindrical brushes 62 and 64.

As will be appreciated by those skilled in the art, many commercially available heat sealing apparatus include gripping or transport belts which extend substantially forward of the remainder of the heat sealing unit such that the open end of a package can be closed prior to reaching the heat sealing elements or plates themselves. It has been found that the tensioning apparatus of the present invention can typically be attached adjacent such pre-existing gripping and transport belts such that the same belts carry the package through both the tensioning apparatus of the present invention and the concurrently used sealing apparatus. However, for applications where the sealing apparatus does not already include such gripping or transport belts, it will be appreciated that such belts or other transport means can readily be provided with the tensioning apparatus of this invention.

Referring again to FIG. 2, it can be seen that the longitudinal or rotational axes 66 and 68 of cylindrical brushes 62 and 64 also lie parallel to the predetermined direction of travel, and in the embodiment shown conical brush 46 is on a common shaft 70 with cylindrical brush 62, and conical brush 48 is on a common shaft 72 with cylindrical brush 64. Also in the embodiment shown, the longitudinal spacing between the conical and cylindrical brushes is selected so as to provide clearance for turn around sprockets 74 and 76 used by transport and gripping belts 28 and 30. As was the case with the conical shaped brushes, cylindrical brushes 62 and 64 rotate in opposite directions so as to draw the excess material into the nip 78 between the tips of the bristles of brushes 62 and 64. The amount of pull on the excess plastic material at the unsealed end of the package, and consequently the tautness of the packaging material around the product, is controlled by the relative location of the tips of the bristles of one of the cylindrical brushes with respect to the tips of the bristles of the other cylindrical brush. It will also be appreciated of course that thick or heavy gauge plastic packaging material may require more pull. The spacing between the tips of the bristles of the cylindrical brushes should vary from a first position where the tips are separated by about one sixteenth (1/16) inch for a loose fit, to a second position where the tips overlap by about three sixteenth (3/16) inch for a taut package using heavy gauge material. FIGS. 3A and 3B are front and side views showing the tip of the brush bristles at the most open position, and FIGS. 4A and 4B show front and side views where the bristle tips overlap the maximum amount.

Typically for most operations, the brush tips will overlap so that a pinching force is applied to the bag thereby causing the bag to be pulled into the brushes and up to a stop member, such as the base plates of the heat sealing machine 32. When the base plates of the heat sealing machine are encountered, the product or article in the bag stops moving while the bag continues to be pulled into the brushes until the bag is tight or taut around the product and is unable to be pulled any more. The bristles will then start slipping on the plastic material. This capability of the brushes to pull the bag taut and then start slipping has the added advantage of being able to straighten a product against the stop member since if one side is taut and the other side is loose, the loose side will continue to be pulled until it is also taut. Thus as is shown in FIG. 2, there is also included an adjusting knob and screw 80 for adjusting the overlap or spacing between the pair of horizontal brushes.

It will be appreciated, of course, that smaller diameter brushes allow for a more compact apparatus and also allows sealing to take place at a point closer to the product. In applications where moisture or water may be present on the packaging material (such as when packaging ice or produce) poor quality seals may result. It has been found that the small diameter brushes of the present invention also act as a squegee to remove water droplets from the seal area thereby reducing sealing problems for those applications. Consequently, the applicant has determined that cylindrical brushes having a circumference of about 7.85 inches (or approximately 2 inches in diameter) seems particularly suitable for most plastic packaging materials. Typically transport and gripping belts 28 and 30 will run at a speed of between about 20 to 110 feet per minute to accommodate the heat sealing machine 32 and test have indicated that to achieve the best results, the speed of the tips of the brush bristles with respect to the linear speed of the transport belts 28 and 30 (i.e. the speed through the brushes) should be a minimum of 5:1. Thus the speed of the brush tips should be a minimum of about 300 to 550 feet per minute. However, it has also been determined that to assure a straight seal on a package, that the speed of the tips of the bristles of the cylindrical brushes should have a speed between about 980 to 1950 feet per minute, and preferably about 1500 feet per minute. Thus a brush with a circumference of 7.85 inches should have a rotational speed of 1500 to 3000 RPM.

In one embodiment, a ⅛ (minimum) horsepower electric motor with variable speed control circuitry and gearing to provide opposite rotation has been found particularly suitable. Such a motor and speed control are indicated by motor 82 and speed control 84 in FIG. 2. Also as shown in FIG. 2, rotational power from drive motor 82 may be provided to the shafts 70 and 72 of the brushes 64 and 66 by drive belts 86 and 88.

Alternately, more brush power and less noise has resulted from another embodiment using two motors which rotate in opposite directions to drive brush shafts 70 and 72.

Thus there has been to this point described the unique apparatus and methods for drawing a plastic bag or packaging material taut around an article or product prior to sealing the bag. It is submitted, however, that although the present invention has been described with respect to specific methods and apparatus, it is not intended that such specific references be considered limitations upon the scope of this invention except as is set forth in the following claims.

I claim:

1. Apparatus for sealing plastic packaging material taut around a product comprising:

conveying means for moving along a predetermined path and having a first and further side, and for carrying a product contained by plastic packaging material having an open end with excess material at said open end, said package oriented on said conveying means such that said excess material extends beyond said further side and transverse to said predetermined path;

a support structure or housing located proximate said further side of said conveying means, and prior to a sealing and trimming means also located along said predetermined path;

guide means adjacent said support structure for gathering said excess plastic packaging material as said package is carried toward said support structure and guiding said material toward an entry point on said support structure;

means extending between said support structure and said sealing and trimming means for gripping said excess plastic material, and at least partially closing said packaging material around said product, and for moving said open end of said packaging material through said support structure and said sealing and trimming means;

a pair of substantially cylindrical shaped brushes contained and supported by said support structure and each rotatable around their longitudinal axis, said longitudinal axis of each of said pair being substantially parallel to said predetermined path, and the tips of the bristles of one of said pair being at least substantially in contact with the tips of the bristles of the other one of said pair, said brushes rotating in opposite directions such that the excess plastic material at the open end of the package is drawn into the nip between the brushes so as to pull the plastic material taut around the product therein;

a pair of conical shaped brushes supported and contained by said support structure and located along said predetermined path ahead of said pair of cylindrical shaped brushes, the longitudinal axes of said conical shaped brushes substantially parallel to said predetermined path, the apex of said conical shaped brushes being toward said entry point and the base of said conical shaped brushes being toward said cylindrical brushes, said tips of the bristles at the base of said brushes being substantially in contact, said conical brushes operating to smooth wrinkles and folds out of said excess plastic material at the open end of said packaging material prior to said packaging material being drawn into the nip of said cylindrical brushes;

means for rotating said cylindrical and said conical shaped brushes; and sealing and trimming means located proximate said further side of said conveying means for sealing said open end of said plastic packaging material drawn taut by said brushes and trimming said excess material.

2. Apparatus operating in combination with means for sealing the open end of plastic packaging around a product and a conveying means to carry said packaging along a predetermined path, said apparatus located at the side of said conveying means and comprising:

a support structure guide means adjacent said housing for gathering excess plastic packaging material at said open end of said package as said conveying means carries said package toward said apparatus, and guiding said material toward an entry point of said apparatus;

means for gripping said excess plastic material, and at least partially closing said packaging material around said product, and for moving said open end of said packaging material through said apparatus;

a pair of cylindrical shaped brushes contained and supported by said support structure and rotatable around their longitudinal axis, said longitudinal axis of each of said pair being substantially parallel to said predetermined path and the tips of the bristles of one of said pair substantially in contact with the tips of the bristles of the other one of said pair, said brushes rotating in opposite directions such that the excess plastic material at the open end of the package is drawn into the nip between the brushes so as to pull the plastic material taut around the product therein prior to sealing said open end;

a pair of conical shaped brushes supported and contained by said support structure and located along said predetermined path ahead of said pair of cylindrical shaped brushes, the longitudinal axes of said conical shaped brushes substantially parallel to said predetermined path, the apex of said conical shaped brushes being toward said entry point and the base of said conical shaped brushes being toward said cylindrical brushes, said tips of the bristles at the base of said brushes being substantially in contact, said conical brushes operating to smooth wrinkles and folds out of said excess plastic material at the open end of said packaging material prior to said packaging material being drawn into the nip of said cylindrical brushes; and means for rotating said cylindrical and said conical shaped brushes.

3. The apparatus of claims 1 or 2 and further including means for adjusting the speed said gripping means moves said packaging material past said cylindrical brushes.

4. The apparatus of claims 1 or 2 and further including means for selectively adjusting the spacing between the tips of the bristles of said cylindrical brushes between a first position wherein the tips are separated by about one sixteenth (1/16) inch, and a second position wherein the tips of the bristles overlap by about three sixteenth (3/16) inch.

5. The apparatus of claims 1 or 2 and further including means for selectively adjusting the spacing between the parallel axes of said conical brushes such that the tips of the bristles at the base of the conical shape are separated by a distance of about one sixteenth (1/16) inch at a first position and overlap by about three sixteenth (3/16) inch at a second position.

6. The apparatus of claims 1 or 2 wherein said means for rotating said cylindrical and said conical shaped brushes is the same means.

7. The apparatus of claim 1 or 2 and further including means for adjusting the rotational speed of said cylindrical brushes.

8. The apparatus of claims 1 or 2 and further including means for adjusting the speed said gripping means moves said packaging material through said cylindrical brushes.

9. The apparatus of claim 7 and further including means for adjusting the speed said gripping means moves said packaging material through said cylindrical brushes.

10. The apparatus of claims 1 or 2 and further including means for adjusting the rotational speed of said cylindrical brushes and said conical brushes.

11. The apparatus of claim 9 wherein said rotational speed and said speed of said gripping means are adjusted such that the ratio of the bristle tip speed of the cylindrical brushes to the speed of the gripping means moving the packaging material is a minimum of 5:1.

12. The apparatus of claim 10 and further including means for adjusting the speed said gripping means moves said packaging material through said cylindrical brushes.

13. The apparatus of claim 10 wherein said rotational speed of said cylindrical brushes is selected such that the speed of the tips of said bristles is between about 980 and 1950 feet per minute.

14. The apparatus of claim 8 wherein said gripping means moves said packaging material through said cylindrical brushes at a speed of between about 20 and 110 feet per minute.

* * * * *